United States Patent [19]

Baughman

[11] Patent Number: 4,817,290

[45] Date of Patent: Apr. 4, 1989

[54] TRIMMING TOOL

[76] Inventor: Larry L. Baughman, R.R. #5, Bryan, Ohio 43506

[21] Appl. No.: 855,325

[22] Filed: Apr. 24, 1986

[51] Int. Cl.[4] ..... B26B 29/00

[52] U.S. Cl. ..... 30/293; 30/294

[58] Field of Search ..... 30/2, 289, 293, 294, 30/290, 286

[56] References Cited

U.S. PATENT DOCUMENTS

| | | | |
|---|---|---|---|
| 2,505,161 | 4/1930 | Van Fleet | 30/2 |
| 2,607,115 | 8/1932 | Lovinelli | 30/293 |
| 2,666,986 | 1/1954 | Codianne | 30/293 |
| 3,037,278 | 6/1962 | Genetti, Sr. | 30/2 |
| 3,363,314 | 1/1968 | O'Brien | 30/125 |
| 3,382,579 | 5/1968 | Prater | 30/329 |
| 3,395,453 | 8/1968 | Prater | 30/293 |
| 3,482,310 | 12/1969 | Paterson | 30/293 |
| 3,500,540 | 3/1970 | Lundquist | 30/294 |
| 3,530,579 | 9/1970 | Dahlke | 30/287 |
| 3,535,786 | 10/1970 | Sanders | 30/293 |
| 3,543,400 | 12/1970 | Scott et al. | 30/280 |
| 3,581,397 | 6/1971 | Kochanowski | 30/293 |
| 3,605,267 | 9/1971 | Brenner | 30/287 |
| 3,621,573 | 11/1971 | Summers | 30/287 |
| 3,653,124 | 4/1972 | Evans | 30/293 |
| 3,726,010 | 4/1923 | Yokoyama | 30/293 |
| 3,737,932 | 6/1973 | Armijo | 7/14.1 |
| 3,787,971 | 1/1924 | Sutton et al. | 30/293 |
| 3,844,038 | 10/1924 | Kelly et al. | 30/293 |
| 3,862,494 | 1/1975 | Andersson | 30/293 |
| 3,934,341 | 1/1926 | Carlson | 30/287 |
| 3,934,342 | 1/1976 | Matsushita | 30/293 |
| 3,991,467 | 11/1976 | Yokoyama | 30/293 |
| 4,001,936 | 1/1977 | Matsushita | 30/287 |
| 4,041,605 | 8/1977 | Selfridge | 30/293 |
| 4,043,038 | 8/1977 | Selfridge | 30/293 |
| 4,064,627 | 12/1977 | Zanfini | 30/287 |
| 4,077,124 | 3/1978 | Christmann | 30/287 |
| 4,095,341 | 6/1978 | Crain | 30/287 |
| 4,130,939 | 12/1978 | Toal | 30/293 |
| 4,501,069 | 2/1985 | Kohno | 30/293 |

*Primary Examiner*—Douglas D. Watts

*Attorney, Agent, or Firm*—Emch, Schaffer, Schaub & Porcello Co.

[57] ABSTRACT

A trimming tool is disclosed having a base where the base has at least one corner. An elongated channel is defined in the base and the elongated channel extends from the corner of the base into the center of the base. A trimming blade is moveably positioned in the elongated channel. The sides of the elongated channel engaged the sides of the trimming blade to maintain the trimming blade in the desired position. The trimming blade is positioned to be extendable from the corner of the base for cutting material. A top is removeably positioned on the base and the top covers the elongated channel and the trimming blade. The top acts to maintain the trimming blade in the elongated channel. A handle secured to the top and the handle is disposed for advancing the trimming tool to cut material.

16 Claims, 2 Drawing Sheets

TRIMMING TOOL

BACKGROUND OF THE INVENTION

This invention relates to a trimming tool that can be used to trim carpet, wallpaper and other sheet-type material. More particularly, the trimming tool is triangular in shape and has a retractable blade extending from one corner of the trimming tool. This configuration facilitates the trimming operation and allows the trimming tool to cut into corners.

Trimming tools have been in use for several years to trim carpeting, wallpaper and other similar sheet materials. Most of these trimmers are substantially rectangular in shape with a blade positioned at each corner on one side of the rectangular body. The blades extend from the side of the trimming tool and the blades engage the material to be cut as the trimming tool was advanced along the material. These tools are rather bulky in nature and made it difficult to cut into a corner where the material to be trimmed may be located. These prior art trimming tools also did not have very good guide surfaces to allow the trimming tool to be advanced along the material to be trimmed to make a straight, even cut in the material. The prior art trimming tools are also constructed so that the tools are too expensive to be purchased by anyone who did not use the tool in a professional business.

Accordingly, it is an object of the present invention to provide an improved trimming tool.

It is a further object of the invention to provide a low cost simple to use trimming tool.

These and other objects and advantages of the invention will be apparent from the following detailed description of the invention.

SUMMARY OF THE INVENTION

A trimming tool is disclosed having a base where the base has at least one corner. An elongated channel is defined in the base and the elongated channel extends from the corner of the base into the center of the base. A trimming blade is moveably positioned in the elongated channel. The sides of the elongated channel engaged the sides of the trimming blade to maintain the trimming blade in the desired position. The trimming blade is positioned to be extendable from the corner of the base for cutting material. A top is removeably positioned on the base and the top covers the elongated channel and the trimming blade. The top acts to maintain the trimming blade in the elongated channel. A handle secured to the top and the handle is disposed for advancing the trimming tool to cut material.

DESCRIPTION OF THE PREFERRED EMBODIMENT

Figure 1:
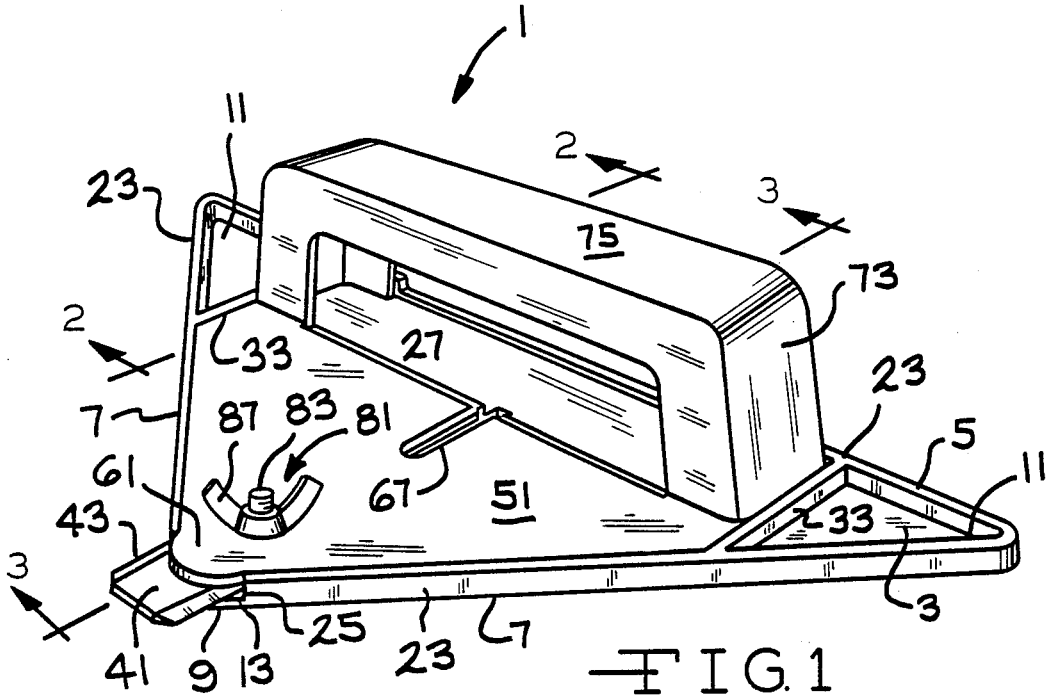
FIG. 1 is a perspective view of the trimming tool of the present invention.

The invention relates to a hand-held trimming tool. More particularly the invention is directed to a trimming tool having an adjustable blade that can be used to trim carpeting, wallpaper and similar linear materials. The features of the invention will be more fully understood by referring to the attached drawings in connection with the following description.

The trimming tool 1 has a relatively flat and thin base 3. The base is substantially triangular in shape and has a backwall 5 and two sidewalls 7. The sidewalls 7 are disposed so that they are orientated substantially perpendicular to one another. The sidewalls 7 are joined together at corner 9 and the corner 9 is rounded. The sidewalls 7 join the backwall 5 at corners 11. The corner 9 is substantially a 90° corner and the corners 11 are substantially 45°. An elongated channel 13 extends from the rounded corner 9 into the center of the base 3. The width of the elongated channel 13 is substantially the same as the diameter of the rounded corner 9. The elongated channel 13 extends to substantially to the midpoint of the triangular base 3 and the sides 15 of the elongated channel 13 are disposed in opposed substantially parallel relationship. The sides 15 are also positioned in substantially perpendicular relationship to the backwall 5 of the base 3. An opening 19 extends through the base in the area of the elongated channel 13. The opening 19 is positioned in adjacent speed apart relationship to the corner 9 and the opening is positioned substantially equidistant between the sides 15 of the elongated channel 13.

A flange 23 extends from the base 3 around the outer periphery of the base. The flange is disposed so that it extends in a direction that is substantially perpendicular to the surface of the base 3. A notch 25 is provided in the flange 23 at the corner 9. The notch 25 is an interruption in the flange 23 that is substantially the same width as the width of the elongated channel 13. Accordingly, there is no flange present where the elongated channel 13 extends into the corner 9. The flange also had a section 27 of reduced height positioned in substantially the center of the backwall 5. Two passageways 29 extend through the flange 23 along the backwall 5 of the base 3. The passageways 29 are positioned immediately adjacent the section 27 of reduced height in the flange 23. Ridges 33 are positioned on the base in opposed substantially parallel relationship. The ridges extend from the flange 23 along the backwall 5 to the flange 23 along the sidewalls 7. Thus, there is a ridge 33 positioned adjacent each corner 11. The ridges 33 extend from the base 3 in a direction that is substantially perpendicular to the base. The ridges 33 also extend from the surface of the base 3 a distance that is substantially equal to the height of the flange 23 and essentially form a continuation of the flange 23 on the base 3. The end of the ridges 33 that are adjacent the backwall 5 are positioned adjacent the sides of the passageway 29 that are spaced apart from the section 27 of reduced height in the flange 23. A cut out 35 is positioned in the base 3 in the area of the elongated channel 13. The sides of the cut out 35 are disposed substantially parallel to the side 15 of the elongated channel 13. The cut out 35 is positioned substantially in the center of the base 3 and a portion of the cut out extends into in the end of the elongated channel 13 that is spaced apart from the rounded corner 9. Extending on each side of the cut out 35 is a curb 37. The curb extends from the base 3 in a direction that is substantially perpendicular to the surface of the base 3. The curb 37 has a height that is from about $\frac{1}{4}$ to about $\frac{3}{4}$ the height of the flange 23. The curb 37 is positioned so that it is substantially parallel to the backwall 5 of the base 3.

A trimming blade 41 having a cutting edge 43 on each side of the trimming blade is positioned in the elongated channel 13. The trimming blade 41 has a width that is substantially the same as the width of the elongated channel 13 and the cutting edges 43 are positioned adjacent the sides 15 of the elongated channel 13. The trimming blade 41 has a length that is less than the length of the elongated channel from the curb 37 to the rounded corner 9. An elongated slot 45 is positioned in the trimming blade. The sides of the elongated slot are disposed to be substantially parallel to the cutting edges 43 on each side of the trimming blade. The elongated slot 45 is positioned so that the slot is in alignment with the opening 19 in the base 3. The trimming blade 41 is movably positioned in the elongated channel 43.

Figure 2:
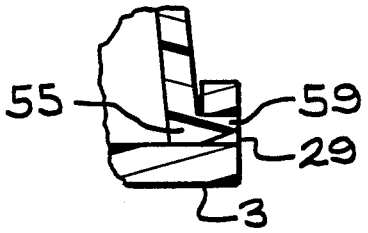
FIG. 2 is a cross-sectional view taken along line 2—2 in FIG. 1.

A top 51 is positioned on the base 3 over the elongated channel 13 and the trimming blade 41. The top 51 has sidewalls 53, endwalls 55 and a backwall 57. The top 51 is positioned on the base 3 so that the sidewalls 53 engage the portion of the flange 23 that extends from the sidewalls 7 of the base 3. The endwalls 55 are positioned to engage the ridges 33 positioned adjacent each corner 11 and the backwall 57 is positioned to engage the curb 37 located in substantially the center of the base 3. Accordingly, the flange 23 along the side walls 7, the ridges 33 and the curb 37 act to locate and position the top 51 on the base 3. A tab 59 extends from each endwall 55 as shown in FIG. 2. The tabs 59 are disposed to extend into the passageways 29 that pass through the flange 23 along the backwall 5 of the base 3. The tabs 59 engage the passageways 29 and also assist to locate and retain the top 51 on the base 3. The sidewalls 53 of the top 51 terminate in a rounded projection 61. The rounded projection 61 is positioned substantially over the rounded corner 9 and the rounded projection has a diameter that is substantially the same as the diameter of the rounded corner. The rounded projection 61 is disposed to fit into the notch 25 in the flange 23.

An aperture 65 is positioned in the top 51 adjacent the rounded projection 61. The aperture 65 is positioned to be in alignment with the opening 19 in the base 3 when the top 51 is properly positioned on the base. A recess 67 extends from the backwall 57 of the top 51 in a direction towards the rounded projection 61. The recess 67 extends in a direction that is substantially perpendicular to the backwall 57. The recess 67 is disposed so that it is in alignment with a portion of the cut out 35 that is located in the base 3.

A handle means 73 is secured to the top 51. The handle means 73 extends from each endwall 55 across the top 51. Although a separate handle 73 can be secured to the top 51, in practice it has been found easier to form the handle 73 as part of the top 51. If plastic materials are being used for the top 51 and the handle 73, the handle can be molded as in integral part of the top 51. The handle means 73 defines a gripping surface 75 that can be utilized to manipulate and advance the trimming tool during a cutting operation.

Figure 3:
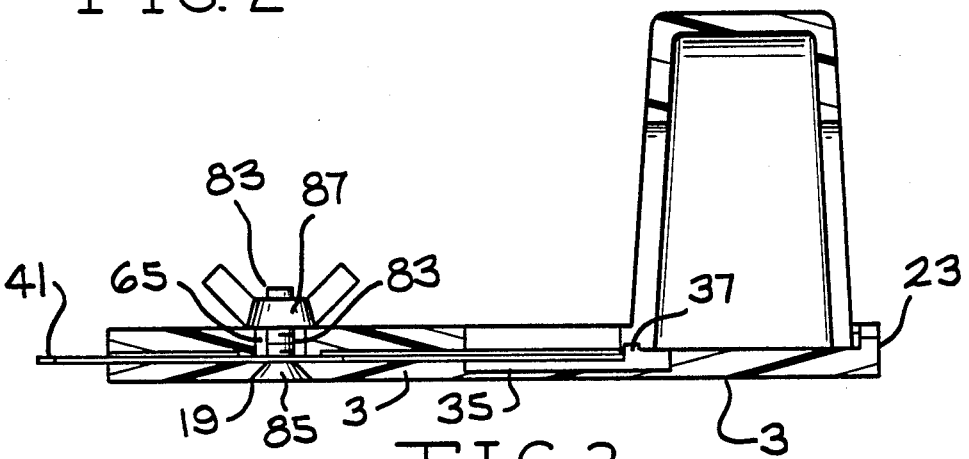
FIG. 3 is a cross-sectional view taken along line 3—3 in FIG. 1.
Figure 4:
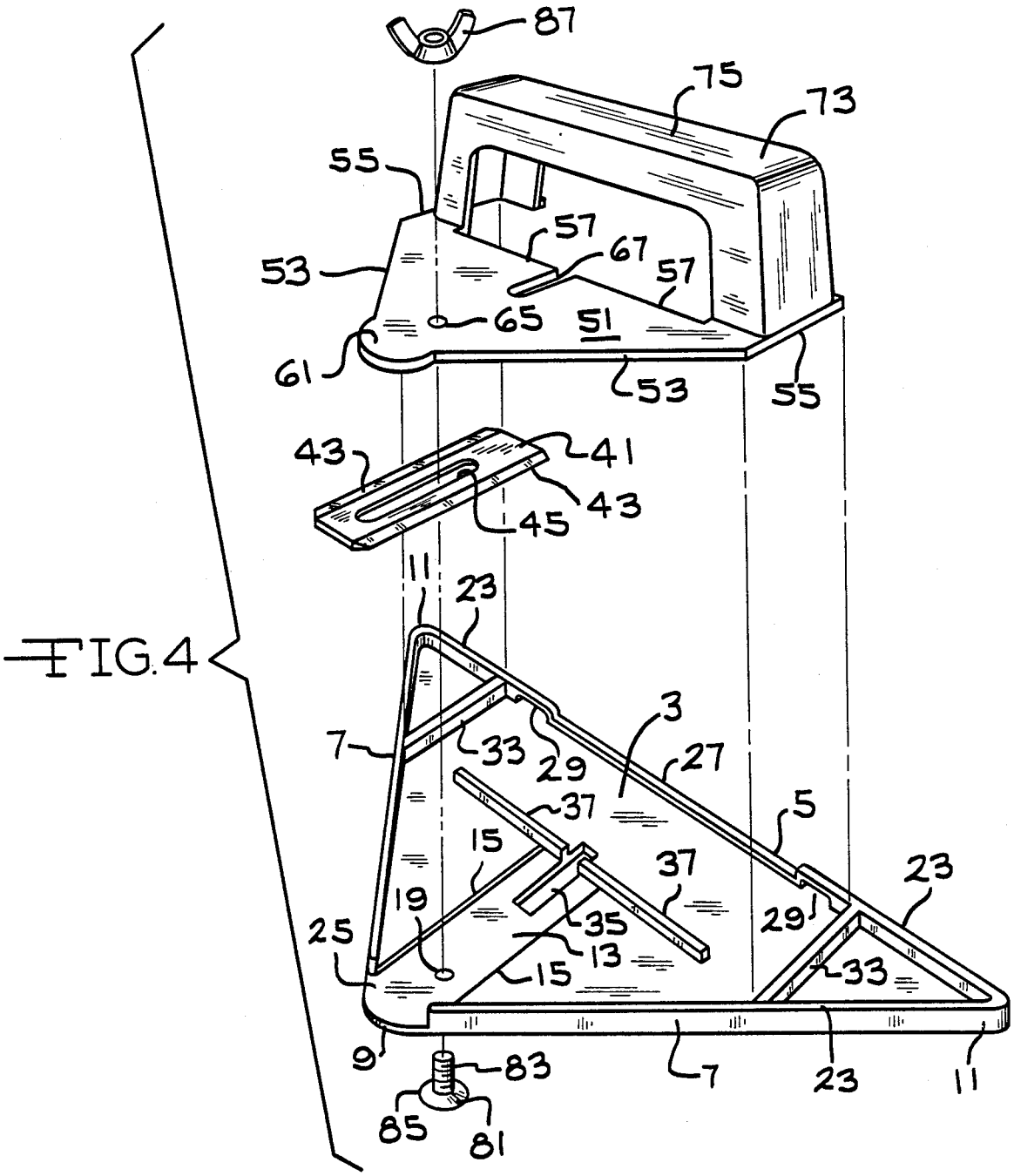
FIG. 4 is an exploded perspective view showing the assembly of the components of the trimming tool.

A securement means 81 extends through the opening 19 in the base 3 through the elongated slot 45 in the trimming blade 41 and through the aperture 65 in the top 51. The securement means acts to assist in securing the top 51 to the base 3 for retaining the trimming blade 41 in the elongated channel 13. The securement means 81 also acts to hold the trimming blade 41 in the desired position in the elongated channel 13. Normally the securement means will be comprised of a bolt 83 having a flat head 85. The opening 19 can be countersunk as shown in FIG. 3 so that the flat head 85 of the bolt 83 will fit flush with or be slightly recessed into the lower surface of the base 3. A wing nut 87 is positioned on the end of the bolt 83 that is spaced apart from the flat head 85. The wing nut 87 can be tightened onto the bolt 83 to secure the top 51 to the base 3 and to maintain the trimming blade 41 in the desired position in the elongated channel 13.

To assemble the cutting tool 1, the trimming blade 41 is positioned in the elongated channel 13 in the base 3. The cutting edges 43 of the trimming blade 41 are positioned immediately adjacent the sides 15 of the elongated 13. The elongated slot 45 in the trimming blade 41 is positioned so that it is in alignment with the opening 19 in the base 3. The top 51 is then positioned on the base 3. The sidewalls 53 of the top 51 are positioned so that they engage the flange 23 that extends from the base 3 along the sidewalls 7 of the base. The endwalls 55 of the top are positioned so that they engage the ridges 33 that are positioned adjacent each corner 11 of the base 3. The backwall 57 of the base 3 is positioned so that it engages the curb 37 positioned in substantially the center of the base. The tabs 59 that extend from the endwalls 55 are positioned in the passageways 29 defined in the flange 23 along the backwall 5 of the base 3. With the top positioned in this manner on the base 3, the aperture 65 in the top will be in alignment with the opening 19 in the base. A securement means 81 is then positioned through the opening 19, the elongated slot 45 in the trimming blade and the aperture 65 in the top 51. The securement means 81 acts to help retain the top 51 in position on the base 3.

The flange 23, ridges 33 and curb 37 of the base 3 all engage sides of the top 51 to properly locate and position the top on the base 3. The flange 23, ridges 33 and curb 37 engage respectively the sidewalls, endwalls and backwall of the top 51 in manner to prevent movement of the top 51 on the base 3. The tabs 59 that project from the endwalls 55 and engage the passageways 59 in the securement means 81 act to prevent the top 51 from being lifted off of the base 3 once the top has been properly positioned thereon.

When the trimming tool 1 is not in use, the trimming blade 41 is positionned in the elongated channel 13 so that one end of the trimming blade engages the curb 37. In this position, the cutting blade does not extend from the elongated channel 13 past the rounded corner 9 and rounded projection 61. The trimming blade 41 is maintained in this position by the securement means 81. This position for the trimming blade 41 can be checked by looking through the recess 67 in the top 51 or the cutout 35 in the base 3. When it is desired to use the trimming tool 1 in a trimming or cutting operation, the securement means 81 is loosened. Normally, this is done by loosening the wingnut 87 that is positioned on the bolt 83 of the securement means. When the securement means has been loosened, the trimming blade 41 is free to move in the elongated channel 13 and the trimming blade can be extended from the elongated channel 13 so that the trimming blade extends past the round corner 9 on the base 3 and the rounded projection 61 on the top 51. This exposes the cutting edges 43 located on each side of the trimming blade 41. The advancement of the trimming blade 41 in the elongated channel 13 is controlled by the elongated slot 45 in the trimming blade. Since the bolt 83 of the securement means 81 passes through the elongated slot 45, this slot will act as a stop to limit the movement of the trimming blade in a direction away from the curb 37. Thus, the trimming blade can only be extended from the trimming tool for a distance that is predetermined by the length of the elongated slot 45. Normally, it is desired to have a length for the elongated slot 45 that does not allow the trimming blade 41 to extend too far beyond the rounded corner 9. on the base 3 as this may result in the blade deflecting during the cutting operation which will produce an uneven cut. Once the blade has been advanced to the desired cutting location, the wingnut 87 on the bolt 83 is again tightened to maintain the trimming blade in the desired location.

With the trimming blade properly advanced, one sidewall 7 of the base 3 is positioned against the surface that is to be trimmed. The trimming tool is then advanced by engaging the gripping surface 75 on the handle means 73 to advance the trimming tool in the desired direction. As the trimming tool is advanced, the cutting edge 43 on the trimming blade 41 will engage and cut the material at the desired location. Because of the substantially triangular shape of the base 3, the trimming tool 1 can be used to cut in either direction by just changing the side wall 7 that is positioned against the material to be cut. This greatly increases the flexibility and usefulness of the trimming tool 1. The triangular shape of the base 3 also allows the trimming tool to fit very closely into corners to cut material and again extends the usefulness of the trimming tool. The positioning of the handle means 73 and the gripping surface 75 also make it very easy for a user to properly grip and advance the trimming tool 1 along the material that is to be cut.

After the trimming tool has been used to make the desired cuts in the material to be trimmed, the securement means 81 is loosened and the trimming blade 41 can be again stored in the elongated channel 13 until it is again desired to use the trimming tool. When the securement means 81 is again tightened the trimming blade 41 will be maintained in the elongated channel 13 and this provides a very safe storage area for the trimming blade 41 and helps to prevent anyone from being accidentally injured from the trimming blade 41 when the trimming tool 1 is not being used.

The above description is given for the sake of explanation. Various modifications and substitutions other than those cited can be made without departing from the scope of the following claims.

What I claim is:

1. A trimming tool comprising:

a substantially triangular-shaped base having at least one corner, said base defining an elongated channel, said elongated channel terminates at said corner, said elongated channel extending from said corner to the center of said base, said base having substantially straight sides that extend on each side of said corner where said elongated channel terminates, said corner where said elongated channel terminates being rounded, said corner having a radius that is at least equal to one-half of the width of said elongated channel;

a trimming blade moveably positioned in said elongated channel, the sides of said channel engaging the sides of said trimming blade to maintain said trimming blade in the desired position. said trimming blade being extendable from said corner of said base for cutting material;

a top removably positioned on said base, said top covering said elongated channel and said trimming blade, said top acting to maintain said blade in said elongated channel; and, a handle secured to said top, said handle being disposed for advancing said trimming tool to cut material, one of said straight sides of said base being held against said material to be trimmed while said tool and said trimming blade are advanced along said material.

2. The tool of claim 1 wherein an aperture passes through said base, said aperture being positioned to pass through said elongated channel, a passageway positioned in said top, said passageway being in alignment with said aperture in said base, an elongated slot located in said trimming blade, said slot being disposed to align with said aperture in said base and said passageway in said top.

3. The tool of claim 2 wherein a releasable securing means extends through said aperture in said base, said elongated slot in said trimming blade and said opening in said top, said securing means securing said top to said base, said securing means acting to maintain said trimming blade in the desired position.

4. The tool of claim 1 wherein said top defines a corner and said corner on said top is substantially the same shape as said corner on said base, said corner on said top being disposed to be in alignment with said corner on said base when said top is properly positioned on said base, said corner on said top acting to assist in retaining said trimming blade in the proper location during use of the trimming tool.

5. The tool of claim 4 wherein said base has a flange that extends in a direction towards said top, said flange engaging said sides of said top to properly locate said top on said base, a passageway passing through said flange in the area of said elongated channel to allow said trimming blade to extend from said base and said top.

6. The tool of claim 5 wherein at least one opening passes through said flange, said top having a projection that is disposed to extend into said opening and to engage said flange, said flange acting on said projection to assist in securing said top to said base.

7. The tool of claim 6 wherein said substantially triangular base has two sidewalls that are positioned in substantially perpendicular relationship, said sidewalls converging together at said rounded corner in said base.

8. The tool of claim 7 wherein a backwall extends between said ends of said sidewalls that are spaced apart from said rounded corner, a corner being formed with said sidewall at each end of said backwall, said corners having an angle of substantially 45°.

9. The tool of claim 8 wherein a curb is positioned on said base at the end of said elongated channel that is spaced from said rounded corner and a ridge extends from said backwall to each sidewall adjacent said corners, said curb being disposed substantially parallel to said backwall and said ridges being disposed substantially perpendicular to said backwall, said curb and said ridges extending in a direction away from said surface of said base, said curb and said ridges extending said sides of said top to assist said flange in aligning and maintaining said top in the desired position on said base.

10. The tool of claim 7 wherein said sidewalls act as a guide surface for said trimming tool, one of said sidewalls being held against said material to be cut as said tool is advanced to acting as a guide surface during said cutting operation.

11. A trimming tool for cutting linear material comprising:

a substantially triangular base, said base having two sidewalls and a backwall, said sidewalls being disposed perpendicular to one another and said sidewalls converging to form a first corner, said sidewalls connected to said backwall and forming second corners, said base having an elongated channel, said elongated channel extending from said first corner into the interior of said base, said sides of said elongated channel being substantially parallel and said elongated channel being substantially perpendicular to said backwall, said first corner being rounded, said first corner having a diameter that is substantially the same as the width of said elongated channel;

an aperture passing through said base, said aperture positioned to pass through said elongated channel;

a flange positioned around the periphery of said base, said flange extending from the surface of said base in a direction that is substantially perpendicular to the surface of said base;

a notch positioned in said flange at said rounded first corner, said notch having a width substantially the same as the width of said elongated channel;

two passageways extending through said flange, said passageways positioned in said portion of said flange extending along said back wall of said base;

a trimming blade moveably positioned in said elongated channel, said trimming blade having a width that is substantially the width of said elongated channel, said sides of said elongated channel being disposed immediately adjacent said sides of said trimming blade and for engaging the sides of said trimming blade, said trimming blade having an elongated slot, said elongated slot being disposed substantially parallel to said sides of said elongated channel, said elongated slot being in alignment with said aperture in said base;

a top removeably positioned on said base, said periphery of said top engaging said flange that extends from said base, said flange acting to align and maintain said top in position on said base, said top positioned over said elongated channel and acting to maintain said trimming blade in said elongated channel;

a pair of tabs positioned on said top, said tabs disposed to extend through said passageway extending through said flange when said top is properly positioned on said base;

a passageway extending through said top, said passageway being in alignment with said aperture in said base and said elongated slot in said trimming blade;

a handle on said top, said handle being disposed for advancing said trimming tool along a surface to cut said linear material; and a releasable securement means passing through said aperture in said base, said elongated slot in said trimming blade and said passageway in said top, said securement means acting to assist in securing said top to said base and in maintaining said trimming in the desired position in said elongated channel.

a handle secured to said top, said handle being disposed for advancing said trimming to cut material, one of said straight sides of said base being held against said material to be trimmed while said tool and said trimming blade are advanced along said material.

12. A trimming tool comprising:

a base having at least one corner, said base defining an elongated channel, said elongated channel extending from said corner into the center of said base;

a trimming blade moveably positioned in said elongaed channel, the sides of said channel engaging the sides of said trimming blade to maintain said trimming blade in the desired position, said trimming blade being extendable from said corner of said blade for cutting material;

a top removeably positioned on said base, said top covering said elongated channel and said trimming blade, said top acting to maintain said blade in said elongated channel;

a flange positioed on said base, said flange extending in a direction towards said top, said flange engaging said sides of said top to properly locate said top on said base, a passageway positioned in said flange in the area of said elongated channel to allow said trimming blade to extend from said base and said top; and, a handle secured to said top, said handle being disposed for advancing said trimming tool to cut material.

13. The tool of claim 12, wherein at least one opening passes through said flange, said top having a projection that is disposed to extend into said opening and to engage said flange, said flange acting on said projection to assist in securing said top to said base.

14. The tool of claim 13, wherein said substantially triangular-shaped base has two sidewalls that are positioned in substantially perpendicular relationship, said sidewalls converging together at said rounded corner in said base.

15. The tool of claim 14, wherein a backwall extends between said ends of said sidewalls that are spaced apart from said rounded corner, a corner being formed with said sidewall at each end of said backwall, said corners having an angle of substantially 45°.

16. The tool of claim 15, wherein a curb is positioned on said base at the end of said elongated channel that is spaced apart from said rounded corner and a ridge extends from said backwall to each sidewall adjacent said corners, said curb being disposed substantially parallel to said backwall and said ridges being disposed perpendicularly to said backwall, said curb and said ridges extending in a direction away from said surface of said base, said curb and said ridges engaging said sides of said top to assist said flange in aligning and maintaining said top in the desired position on said base.

* * * * *